US005914560A

United States Patent [19]

Winsor

[11] Patent Number: 5,914,560

[45] Date of Patent: Jun. 22, 1999

[54] WIDE ILLUMINATION RANGE PHOTOLUMINESCENT LAMP

[75] Inventor: Mark D. Winsor, Seattle, Wash.

[73] Assignee: Winsor Corporation, Olympia, Wash.

[21] Appl. No.: 08/941,110

[22] Filed: Sep. 30, 1997

[51] Int. Cl.[6] ..... H01J 1/62

[52] U.S. Cl. ..... 313/493; 313/634

[58] Field of Search ..... 313/422, 484, 313/485, 493, 514, 519, 634

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |

(List continued on next page.)

FOREIGN PATENT DOCUMENTS

| | | | |
|---|---|---|---|
| 0 066 495 A2 | 12/1982 | European Pat. Off. | H01J 61/32 |
| 0 329 226 A1 | 8/1989 | European Pat. Off. | H01J 65/04 |
| 0 550 047 A2 | 7/1993 | European Pat. Off. | H01J 61/70 |
| 89 04 853 | 8/1989 | Germany | H01J 61/67 |
| 39 22 865 A1 | 1/1991 | Germany | H01J 65/04 |
| 43 13 017 A1 | 12/1994 | Germany | H01J 61/70 |
| 60216435 | 10/1985 | Japan . | |
| 62208536 | 9/1987 | Japan . | |
| 1017374 | 1/1989 | Japan . | |
| 64-17374 | 1/1989 | Japan | H01J 61/30 |
| 1206553 | 8/1989 | Japan . | |
| 2-72552 | 3/1990 | Japan | H01J 61/30 |
| 2-78147 | 3/1990 | Japan | H01J 61/30 |
| 3-46748 | 2/1991 | Japan | H01J 61/94 |
| 3-129659 | 6/1991 | Japan | H01J 61/35 |
| 3-222253 | 10/1991 | Japan | H01J 61/92 |
| 3-285249 | 12/1991 | Japan | H01J 61/32 |
| 4-95337 | 3/1992 | Japan | H01J 61/67 |
| 4-147554 | 5/1992 | Japan | H01J 61/30 |
| 2 032 681 | 5/1980 | United Kingdom . | |
| 2 217 515 | 10/1989 | United Kingdom | H01J 61/30 |
| WO 87/04562 | 7/1987 | WIPO . | |
| WO 92/02947 | 2/1992 | WIPO | H01J 61/30 |

OTHER PUBLICATIONS

Mercer et al., "Fluorescent backlights for LCDs," *Information Display:* 8–13, Nov. 1989.

Hinotani et al., "Flat Fluorescent Lamp for LCD Back–Light," *1988 International Display Research Conference.*

*Primary Examiner*—Vip Patel

*Attorney, Agent, or Firm*—Seed and Berry LLP

[57] ABSTRACT

A wide illumination range photoluminescent lamp utilizes a primary set of electrodes positioned to generate an plasma discharge along a serpentine channel to produce a high level of visible light. A pair of secondary electrodes may be activated to alter the discharge path for the plasma discharge such that a low level of visible output light is produced. The lamp includes a light guide diffuser over a transparent cover to diffuse the light in the low operational mode and generate uniform light over a wide range of illumination levels. The secondary electrodes may be mechanically activated or automatically activated based on the amount of ambient light.

67 Claims, 11 Drawing Sheets

U.S. PATENT DOCUMENTS

| | | | |
|---|---|---|---|
| 4,482,580 | 11/1984 | Emmett et al. | 427/66 |
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,645,337 | 7/1997 | Gleckman | 362/29 |

WIDE ILLUMINATION RANGE PHOTOLUMINESCENT LAMP

TECHNICAL FIELD

The present invention is related generally to planar photoluminescent lamps, and, more particularly, to planar photoluminescent lamps having a wide illumination range.

BACKGROUND OF THE INVENTION

Planar fluorescent lamps are useful in many applications, including backlights for displays such as liquid crystal displays. A common weakness in such fluorescent lamps is their limited illumination range.

Planar fluorescent lamps typically utilize an electric plasma discharge through a low pressure mercury vapor and buffer gas to produce ultraviolet radiation. The ultraviolet radiation strikes a fluorescent material which converts the ultraviolet radiation to visible light. To produce the low pressure plasma discharge, such lamps typically require a substantial minimum energy input. If the lamps are driven below the minimum energy input, the plasma discharge may not be formed, or may be highly non-uniform. Moreover, the efficiencies of such lamps can be degraded substantially at low level operation. To improve uniformity and efficiency, such lamps typically must be driven well above their minimum energy input levels so that a complete, uniform plasma discharge can be formed. At such high energy levels, the lamp emits a substantial amount of light, typically in a range exceeding 100 foot-lamberts or 342 candles per square meter (cd/m$^2$).

While such light intensities may be useful in relatively high ambient light applications, in some applications such a high level of light intensity can be detrimental. For example, when high intensity fluorescent lamps are used to provide illumination for nighttime displays in automobiles, high levels of light make it difficult for the driver to view objects outside of the automobile. Consequently, it is often desirable to dim the fluorescent lamps to levels well below 1.0 foot-lambert (34 cd/m$^2$).

To improve dimmability, a filter can be added to high intensity fluorescent lamps to block out some of the light. However, filtering can reduce the maximum light intensity of the lamps, rendering them ineffective in high ambient light environments or produce extra heat with less lumens per watt of power consumed by the lamp.

Therefore, it can be appreciated that there is a significant need for a planar fluorescent lamp having a wide illumination range. The present invention offers these and other advantages, as will be apparent from the following description and accompanying figures.

SUMMARY OF THE INVENTION

One embodiment of the present invention includes a fluorescent lamp having a lamp body and a lamp cover such that the body and cover define a chamber having a channel length extending from a first end to a second end. The lamp includes a first electrode in proximity with the first end and a second electrode in proximity with the second end. The first and second electrodes are configured to produce an electrical discharge therebetween along the channel length when supplied with electrical power. The lamp also includes a set of secondary electrodes spaced apart within the chamber at positions other than the first and second ends to produce an electrical discharge along a discharge path different than the channel length. An activation element selectively activates the second set of electrodes whereby the lamp produces a first quantity of visible light in response to the emission of ultraviolet energy along the channel length discharge path and a second quantity of visible light less than the first quantity of visible light in response to the emission of ultraviolet energy along the shortened discharge path.

In one embodiment, the channel length discharge path and the different discharge path are under a common vacuum and have similar photoluminescent coatings to emit light of substantially similar wavelengths. With the common vacuum between the channel discharge length and the different discharge length, the first and second electrodes are configured to receive an electrical voltage when supplied with electrical power and the set of secondary electrodes are positioned within the chamber to provide an electrical short circuit of a portion of the channel discharge path to thereby alter the discharge path.

In an alternative embodiment, the different discharge path is under a separate vacuum and may contain photoluminescent materials selected to emit light of a different wavelength than the channel length discharge path. In this embodiment, the first and second electrodes and the set of secondary electrodes are individually powered. The set of secondary electrodes may be powered by a DC power supply to eliminate capacitive coupling across the channel wall to prevent excitation along the channel length.

In an exemplary embodiment, the different discharge path is along a peripheral edge of the lamp. The lamp may also include a light diffusion element mounted adjacent the lamp cover to diffuse the reduced level of light. The light diffusion element is particularly useful in diffusing light generated along the different discharge path. The light diffusion element may include a plurality of indentations on a surface thereof to provide uniform diffusion of light.

In another alternative embodiment, the lamp comprises a lamp housing, a first light source within the housing to generate visible light in a first operational mode, and a second light source within the lamp housing, in a substantially planar arrangement with respect to the first light source, to generate visible light in the second operational mode. A circuit alternatively selects the first or second operational modes for the lamp. The lamp also includes a light diffusion element mounted adjacent the lamp housing to diffuse the visible light in the first and second operational modes. The light diffusion element has a first surface facing toward the first and second light sources to receive light generated in both first and second operational modes. The light diffusion element also has a second surface, opposite the first surface, to emit light in both the first and second operational modes.

In this embodiment, the first light source may be a serpentine channel formed by the lamp housing and coated with fluorescent material. The serpentine channel is filled with a gas to excite a photoluminescent material in the presence of a plasma discharge to generate visible light in the first operational mode. Alternatively, the light source may comprise a plurality of individual photoluminescent tubes mounted within the lamp housing. Similarly, the second light source may be formed by a channel along the peripheral edge of the lamp housing and coated with a photoluminescent material or at least a first photoluminescent tube mounted within the lamp housing. The first light source may alternatively comprise an open chamber photoluminescent display. In one embodiment, the first and second light sources may use substantially similar photoluminescent material to produce visible light with similar spectral characteristics. Alternatively, the first and second light sources may include different photoluminescent material to produce visible light having differing spectral characteristics.

The lamp may include hot or cold cathode type electrodes, which may be mounted internally within the lamp housing or mounted externally outside the lamp housing. The first and second electrodes are part of the first light source and generate an plasma discharge therebetween when electrical power is applied to the electrodes.

The light diffusion element also includes multiple embodiments. In one embodiment, the light diffusion element includes a first beveled edge proximate the second light source to deflect light generated in the second operational mode. The light diffusion element may include a series of indentations to further deflect light generated in the second operational mode to thereby direct light out of the second surface of the light diffusion element. In addition, the lamp may include a light reflecting element associated with the beveled edge to reflect the light from the beveled edge. Alternatively, the light diffusion element may include a half-tone pattern on a selected one of the first and second surfaces to diffuse light. In another alternative embodiment, the light diffusion element may include a half-mirrored surface on the first surface to reflect light generated by the second light source. In another alternative embodiment, the light diffusion element may include a plurality of beveled edges proximate the second light source to deflect light generated in the second operational mode. In yet other alternative embodiments, the light diffusion element may be a wedge-shaped element or a rectangular-shaped block.

DETAILED DESCRIPTION OF THE INVENTION

Figure 1:
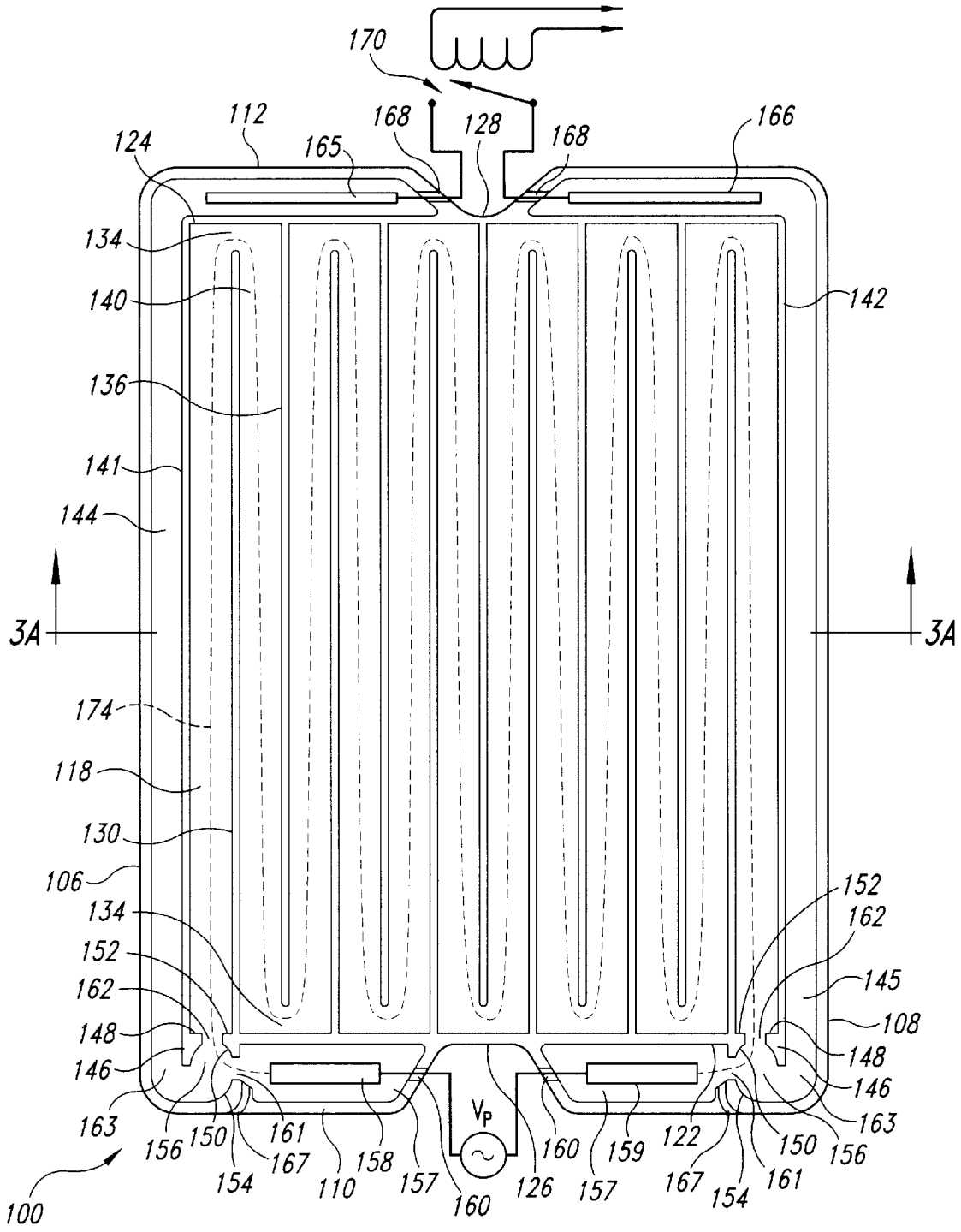
FIG. 1 is a top plan view of one embodiment of a lamp according to the present invention and operating in a first operational mode.

A planar fluorescent lamp 100, shown in FIGS. 1–3B, includes a lamp body 102 of a transparent glass. The lamp body 102 is formed from a base 104 having first and second sidewalls 106 and 108 and first and second endwalls 110 and 112 projecting upwardly therefrom to form a recess. A transparent glass lamp cover 116 overlays the recess and is bonded to the sidewalls 106 and 108 and the endwalls 110 and 112 such that the lamp body 102 and lamp cover 116 together form a sealed chamber 118.

Within the chamber 118 are first and second channel endwalls 122 and 124, which are substantially parallel to and spaced apart from the first and second endwalls 110 and 112, respectively. The first endwall 110 includes a curved central portion 126 that intersects the first channel endwall 122. Similarly, the second endwall 112 includes a curved central portion 128 that intersects the second channel endwall 124.

A plurality of channel walls 130 project from the first channel endwall 122 toward the second channel endwall 124. The channel walls 130 terminate a short distance from the second channel endwall 124 forming gaps 134 between the distal ends of the channel walls 130 and the second channel endwall 124. A complementary set of channel walls 136 extend from the second channel endwall 124 toward the first channel endwall 122 and form similar gaps 134 at their distal ends. The channel walls 130 and 136 are spaced apart at substantially equal intervals intermediate the first sidewall 106 and the second sidewall 108 to define a serpentine channel 140. In a preferred embodiment, the serpentine channel 140 has an aspect ratio less than 3:1. Thus, the serpentine channel 140 is no more than three times wider than the depth of the serpentine channel. The channel walls 130 and 136 are glass walls integral to the lamp body 102 and project upwardly from the base 104 toward the lamp cover 116.

Also included within the chamber 118 is a first outer channel wall 141 and a second outer channel wall 142. The first outer channel wall 141 projects from the second channel endwall 124 and runs parallel to the first sidewall 106 to form a narrow first outer channel 144. Similarly, the second outer channel wall 142 projects from the second channel endwall 124 and runs parallel to the second sidewall 108 to form a narrow second outer channel 145.

In a first operational mode of the lamp 100, which may also be referred to as a high intensity or day mode, gas within the chamber 118 is ionized along the serpentine channel 140 to provide a high intensity fluorescent light. In a second mode of operation, which may also be referred to as a low intensity or night mode, the ionization within the chamber 118 occurs primarily in the first and second outer channels 144 and 145 to provide a low-intensity fluorescent light.

The first and second outer channel walls 141 and 142 are longer than the channel walls 136 and each include a contoured blocking member 146. Each contoured blocking member 146 includes a shoulder 148 that projects from the first and second outer channel walls 144 and 145 toward the second channel endwall 122. The second endwall 122 also includes a contoured blocking member 150 at each end. Each contoured blocking member 150 also includes a shoulder 152 projecting toward the shoulder 148 of the contoured blocking member 146. The contoured blocking members 146 and 148 include a curved partially circular surface facing toward the first endwall 110. The first endwall 110 also includes a circular projection 154, which cooperates with the curved partially circular surfaces of the contoured blocking members 146 and 148 to define a getter space 156 within the chamber 118. Each getter space 156 is sized to retain a getter (not shown) within the plasma discharge pathway in both the first and second modes of operation. As is well known in the art, the getter chemically interacts with and removes impurities from the gas in the chamber 118.

The various sidewalls, endwalls, and channel walls are all bonded to the lamp cover 116 by a glass solder. The first and second sidewalls 106 and 108 and the first and second endwalls 110 and 112 serve to provide a seal for the chamber 118. The channel walls 130 and 136 are bonded to the lamp cover 116 by the glass solder such that the channel walls provide insulative barriers between adjacent sections of the serpentine channel 140. The glass solder between the lamp cover 116 and the first and second outer channel walls 141 and 142 provide insulative barriers between the serpentine channel 140 and the first and second outer channels 144 and 145.

The first end wall 110, first channel wall 122, and the curved portion 126 of the first end wall define compartments 157. First and second primary electrodes 158 and 159 are cold cathode electrodes positioned within the compartments 157. Portals 160 in the curved portion 126 of the first endwall 110 permit passage for electrical wires for external connection of the first and second primary electrodes 158 and 159. During assembly, conventional glass soldering techniques are used to seal the portals 160 to provide an airtight seal. Although the exemplary embodiment of the lamp 100 illustrates internally mounted cold cathode type electrodes, hot electrodes or dual hot-cold cathodes may also be used in accordance with the principles of the present invention. In addition, the cathodes may be externally mounted outside the lamp body 102, which is known in the art as an electrodeless lamp.

The curved portion 126 of the first endwall 110 increases physical separation between the first and second primary electrodes 158 and 159. Without the increased separation, the first and second primary electrodes 158 and 159 can generate an electromagnetic field across a single channel of the serpentine channel 140, thus ionizing gas and creating an ionized bright spot where visible light is emitted. However, the curved portion 126 provides additional physical separation between the first and second primary electrodes 158 and 159, so that any stray electromagnetic field is coupled between the first and second primary electrodes over a distance of several channel lengths of the serpentine channel 140. Thus, there is no ionized bright spot created by the proximity of the first and second primary electrodes 158 and 159.

The contoured blocking member 150 and curved portion 154 of the first endwall 110 serve to define a passageway 161 between the getter space 156 and the compartment 157. The shoulder 148 of the contoured blocking member 146 and the shoulder 152 of the contoured blocking member 150 serve to define a passageway 162 between the getter space 156 and the serpentine channel 140. The terminating end of the contoured blocking member 146 and the first endwall 110 serve to define a passageway 163 between the getter space 156 and the first and second outer channels 144 and 145.

The first and second primary electrodes 158 and 159, upon electrical excitation by a power supply $V_p$, produce an plasma discharge. In the high intensity mode, the plasma discharge travels along the serpentine channel 140 between the first and second primary electrodes. The current flow of the plasma discharge follows a pathway through the passageway 161, the getter space 156, the passageway 162, and along the serpentine channel 140. The power supply $V_p$ typically supplies a high voltage alternating current (AC) signal. However, a direct current (DC) power supply can also be used for the power supply $V_p$.

A gas within the chamber 118, which may include mercury vapor, reacts to the plasma discharge and produces ultraviolet radiation in response thereto. The ultraviolet radiation is converted to visible light energy by a fluorescent layer 164 which coats the interior of the recess, including the channel walls 130 and 136, the interior portion of the first and second sidewalls 106 and 108, and the first and second outer channel walls 141 and 142. The visible light energy $L_p$ emitted by the fluorescent layer 164 is transmitted to an observer through the transparent lamp cover 116. The visible light energy $L_p$ caused by the plasma discharge in the high intensity mode is emitted in a range from about 250 to 3,000 foot-lamberts (856 to 10,278 cd/m$^2$).

Although mercury vapor is frequently used in fluorescent lamps, it is well known to use other gases, such as Argon, Xenon, a mixture of inert and halogen gases and the like, either alone or in combination to produce the desired spectral characteristics. In addition, it is known to vary the lamp pressure to alter the spectral characteristics of the lamp for a given gas. Furthermore, it is known to use photoluminescent materials other than phosphors to generate visible light in response to excitation by UV radiation. Accordingly, the present invention is not limited by the lamp pressure, the type of photoluminescent material, or type of gas used to fill the lamp 100.

Apertures 167 in the first endwall 110 are used to introduce the gas into the lamp 100. The evacuation of the chamber 118 and the introduction of the gas is accomplished in a well-known fashion, which need not be described herein. Following the introduction of gas into the lamp 100, the apertures 167 are sealed using conventional glass soldering techniques.

The lamp 100 also includes first and second secondary electrodes 165 and 166, located intermediate the second endwall 112 and the second channel endwall 124, and on opposite sides of the curved portion 128 of the second endwall. Apertures 168 in the curved portion 128 of the second endwall 112 permit passage of electrical wires for external connection of the first and second secondary electrodes 165 and 166. During assembly, conventional glass soldering techniques are used to seal the apertures 168 to provide an airtight seal.

Figure 2:
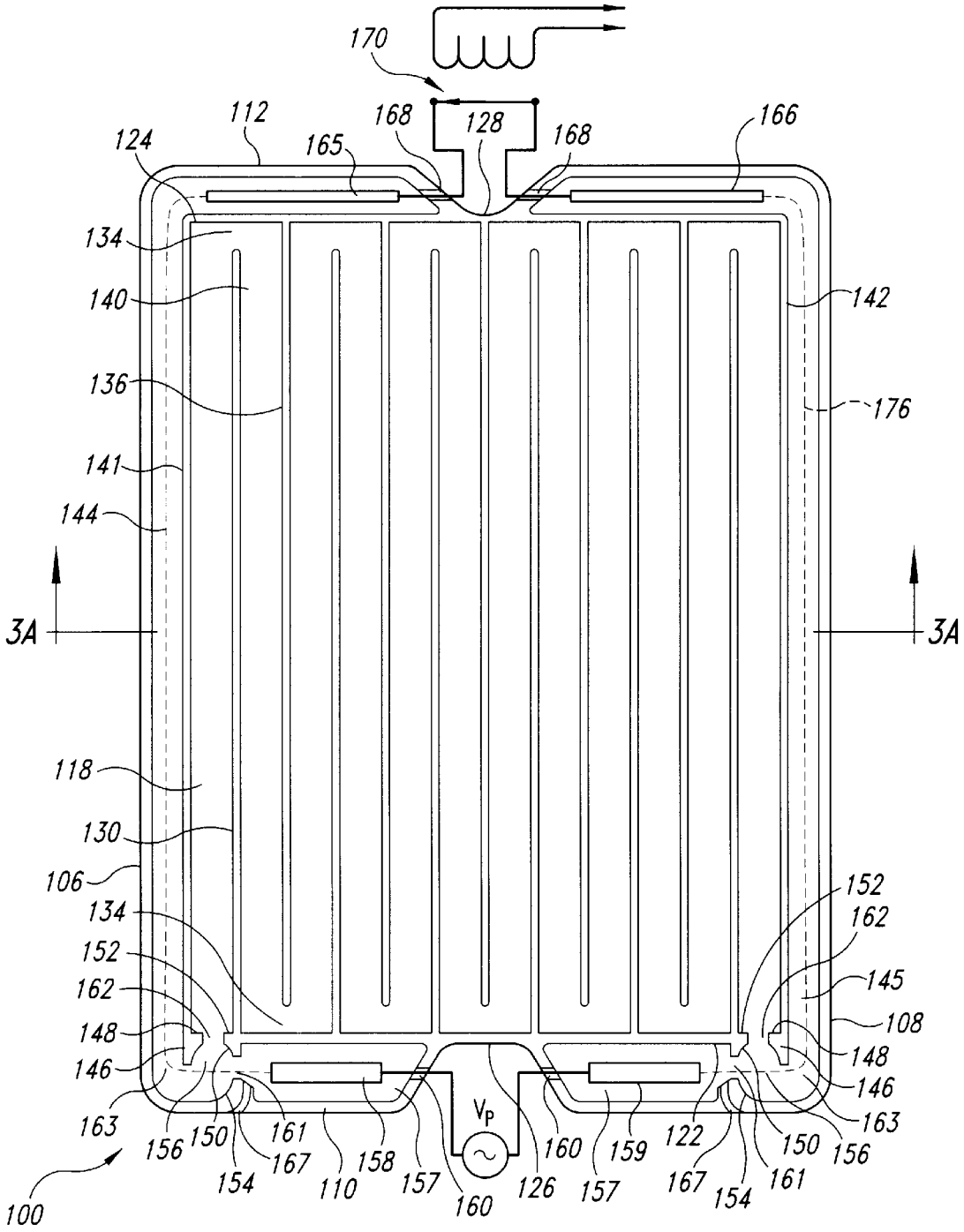
FIG. 2 is a top plan view of the lamp of FIG. 1 operating in a second operational mode.

The first and second secondary electrodes 165 and 166 are activated in the low intensity mode of the lamp 100. In an exemplary embodiment, illustrated in FIGS. 1 and 2, the first and second secondary electrodes 165 and 166 do not receive external power, but are coupled to an activation element 170, which is illustrated in FIGS. 1 and 2 as a relay, having relay contacts coupled to the first and second secondary electrodes 165 and 166, respectively, and a relay coil to selectively couple the relay contacts. Alternative embodiments of the activation element 170 are described below. The activation element 170 provides a short-circuit pathway between the first and second secondary electrodes 165 and 166.

In the high intensity mode, the activation element 170 is open so there is no electrical continuity between the first secondary electrode 165 and the second secondary electrode 166. In the high intensity mode, the lamp 100 generates visible light energy $L_p$ in response to the plasma discharge along the serpentine channel 140 between the first and second primary electrodes 158 and 159. In the low intensity mode, the activation element 170 is closed to provide electrical contact between the first and second secondary electrodes 165 and 166.

In the low intensity mode, the plasma discharge travels along a shorter pathway than the electric discharge pathway through the serpentine channel 140. This alternative shorter plasma discharge pathway is between the first and second primary electrodes 158 and 159 along the first and second outer channels 144 and 145 and through the first and second secondary electrodes 165 and 166, which are electrically connected by the activation element 170.

FIG. 1 illustrates the high intensity mode, where the plasma discharge travels along the serpentine channel 140 in a pathway illustrated by a dashed line 174. In the high intensity mode, the first and second secondary cathodes 165 and 166 are inactive. The contoured blocking members 146 serve to prevent accidental ionization of gas within the first and second outer channels 144 and 145. The use of the serpentine channel 140 in planar fluorescent lamps is well known in the art, and need not be described in detail herein. However, as can be appreciated by those of ordinary skill in the art, the increase in the length of the plasma discharge through the serpentine channel 140 increases the overall efficiency of the lamp 100 and the amount of visible light energy $L_p$ generated by the lamp.

The brightness of the lamp 100 in the high intensity mode is controlled in a conventional manner. As is known in the art, the brightness of a lamp is proportional to the current flowing in the plasma discharge. Amplitude modulation (AM) and pulse width modulation (PWM) are two known techniques to vary the current and thus control the brightness of the lamp 100. AM brightness control has the advantage of simplicity in circuit operation, but has the disadvantage of difficulty in starting the lamp at low intensities where the voltage of the power supply $V_p$ may be too low to initiate the plasma discharge. Although PWM brightness control requires greater complexity in the control circuit, the lamp 100 may be readily started at any brightness level. The operation of brightness control circuits is well known in the art, and will not be described in further detail.

In the high intensity mode, the brightness of the lamp 100 can be varied from approximately 100 foot-lamberts (343 cd/m$^2$) to more than 3,030 foot-lamberts (10,380 cd/m$^2$). Thus, the lamp 100 provides a high level of illumination, which is useful in applications with a high level of ambient light.

For operation in applications with low ambient light, the lamp 100 operates in the low intensity mode, which is enabled by closing the activation element 170, thus providing a short circuit between the first and second secondary electrodes 165 and 166. The first and second secondary electrodes 152 operate in conjunction with the first and second primary electrodes 144 and 146 to provide a shortened plasma discharge pathway, illustrated by a dashed line 176 in FIG. 2. As can be seen in FIG. 2, the plasma discharge travels between the first and second primary electrodes 158 and 159 along the pathway 176 through the passageway 161, the getter space 156, the passageway 163, and along the first and second outer channels 144 and 145. Accordingly, ultraviolet radiation is generated only along the shortened discharge pathway 176 rather than in the serpentine channel 140. The shoulder 148 of the contoured blocking member 146 and the shoulder 152 of the contoured blocking member 150 serve to prevent accidental ionization of gas within the serpentine channel 140 when the lamp 100 is operating in the low intensity mode.

The brightness of the lamp 100 in the low intensity mode is controlled in the manner described above, such as by use of AM, DC or PWM control circuits. In the low intensity mode, the lamp 100 produces visible light energy $L_p$ in a range from less than 1.0 foot-lamberts (3.4 cd/m$^2$) to more than 125 foot-lamberts (428 cd/m$^2$).

The serpentine channel 140 provides uniform light intensity across substantially the entire lamp cover 116 when the lamp 100 is in the high intensity mode. In the low intensity mode, visible light energy $L_p$ is produced primarily only in the first and second outer channels 144 and 145. To distribute the light in the low intensity mode, the lamp includes a translucent light guide 180, illustrated in FIG. 3A, to diffuse the light generated in the first and second outer channels 144 and 145. In operation, the light guide 180 is mounted on top of the lamp cover 116 and includes first and second beveled edges 182 and 184. The beveled edges 182 and 184 are formed at approximately 45 degrees with respect to the surface of the light guide 180 facing the lamp cover 116. In this manner, visible light projected through the lamp cover 116 from the first outer channel 144 is reflected by the first beveled edge 182 and directed along a length of the light guide 180. Similarly, visible light projected through the lamp cover 116 from the second outer channel 145 is reflected by the second beveled edge 184 and directed along the length of the light guide 180.

A pair of spacers 183 maintains the light guide 180 at a predetermined distance from the lamp cover 116. In a preferred embodiment, the spacers 183 are made from a clear acrylic material. Reflective members 185 cover the first and second beveled edges 182 and 184 to increase the reflection of light from the first and second outer channels 144 and 145. The reflective members 185 also extend partially across the top surface of the light guide 180 in the region close to the first and second outer channels 144 and 145. The reflective members 185 serve to increase the amount of light reflected from the first and second outer channels 144 and 145 to travel along the length of the light guide 180. In an exemplary embodiment, reflective members 185 may also be added to the edge portions of the light guide 180 adjacent to the beveled edges 184 and 185. The light guide 180 serves to diffuse the light projected from the first and second outer channels 144 and 145 to provide greater uniformity of light from the lamp 100 while operating in the low intensity mode.

Figure 3A:
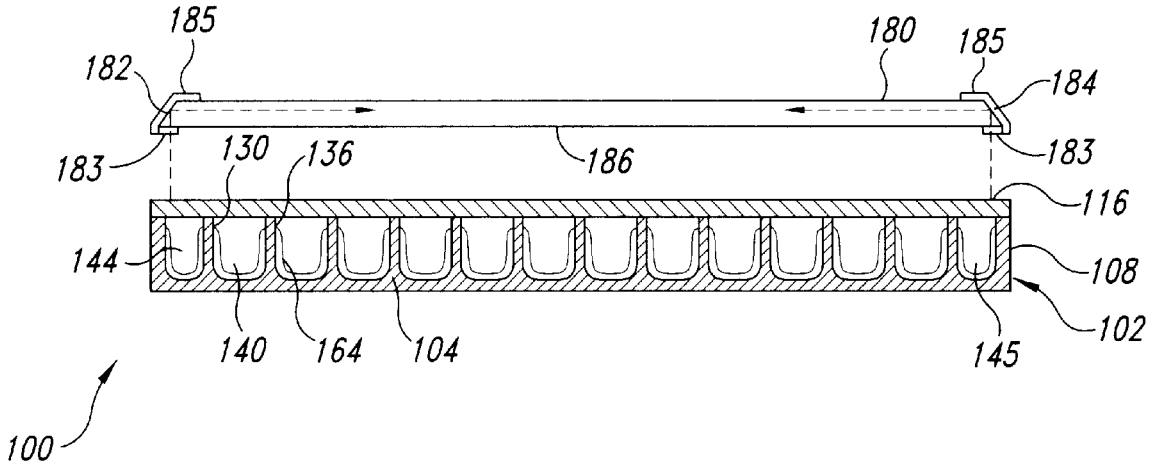
FIG. 3A is a side elevational view of the lamp of FIGS. 1 and 2.
Figure 3B:
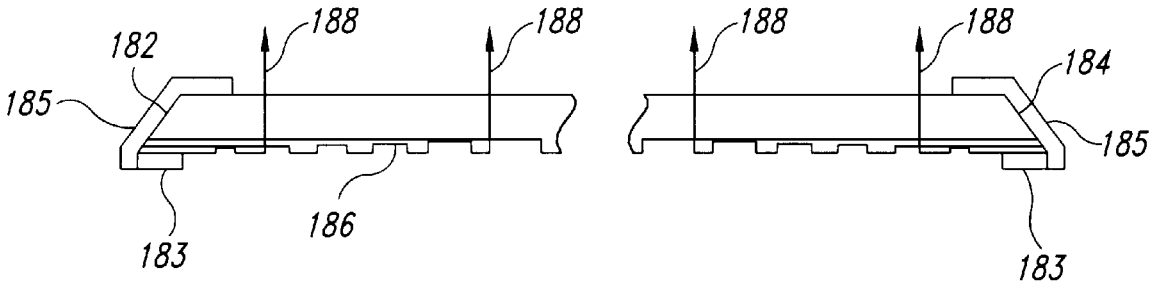
FIG. 3B is an enlarged fragmentary view of the light guide of FIG. 3A.

The light guide 180 includes a series of indentations 186, which can be seen in FIG. 3B, which is an enlarged fragmentary view of the light guide 180 of FIG. 3A. The indentations 186 provide greater diffusion of the light in the low level light mode and thus provide greater uniformity of light across the entire surface of the lamp 100. As light travels along the length of the light guide 180, it strikes the indentations 186 and is reflected to the upper surface of the light guide, as illustrated by arrows 188 in the fragmentary enlargement of FIG. 3B. Although the deflection of light by the indentations 186 is illustrated in FIG. 3B by a single upward projecting arrow 188, it can be appreciated that the indentations 186 serve to reflect the light in many different directions, thus causing general diffusion of the light. As can be appreciated by those of ordinary skill in the art, the indentations 186 near the beveled edges 182 and 184 deflect light, which is diffused toward the upper surface of the light guide 180 and is thus not available to strike indentations in the central portion of the light guide. If all indentations 186 were the same size, no light would reach the indentations in the central portion of the light guide 180, which would result in non-uniformity of light. To avoid this problem, the depth of the indentations 186 increases incrementally from the beveled edges 182 and 184 to a maximal depth of indentation approximately midway along the length of the light guide 180. This allows some light to strike the indentations in the central portion and thus provide great uniformity of light throughout the light guide 180. The indentations 186 also serve to diffuse the light emitted from the serpentine channel 140 and thus diffuse the light in the high intensity mode as well.

Figure 4:
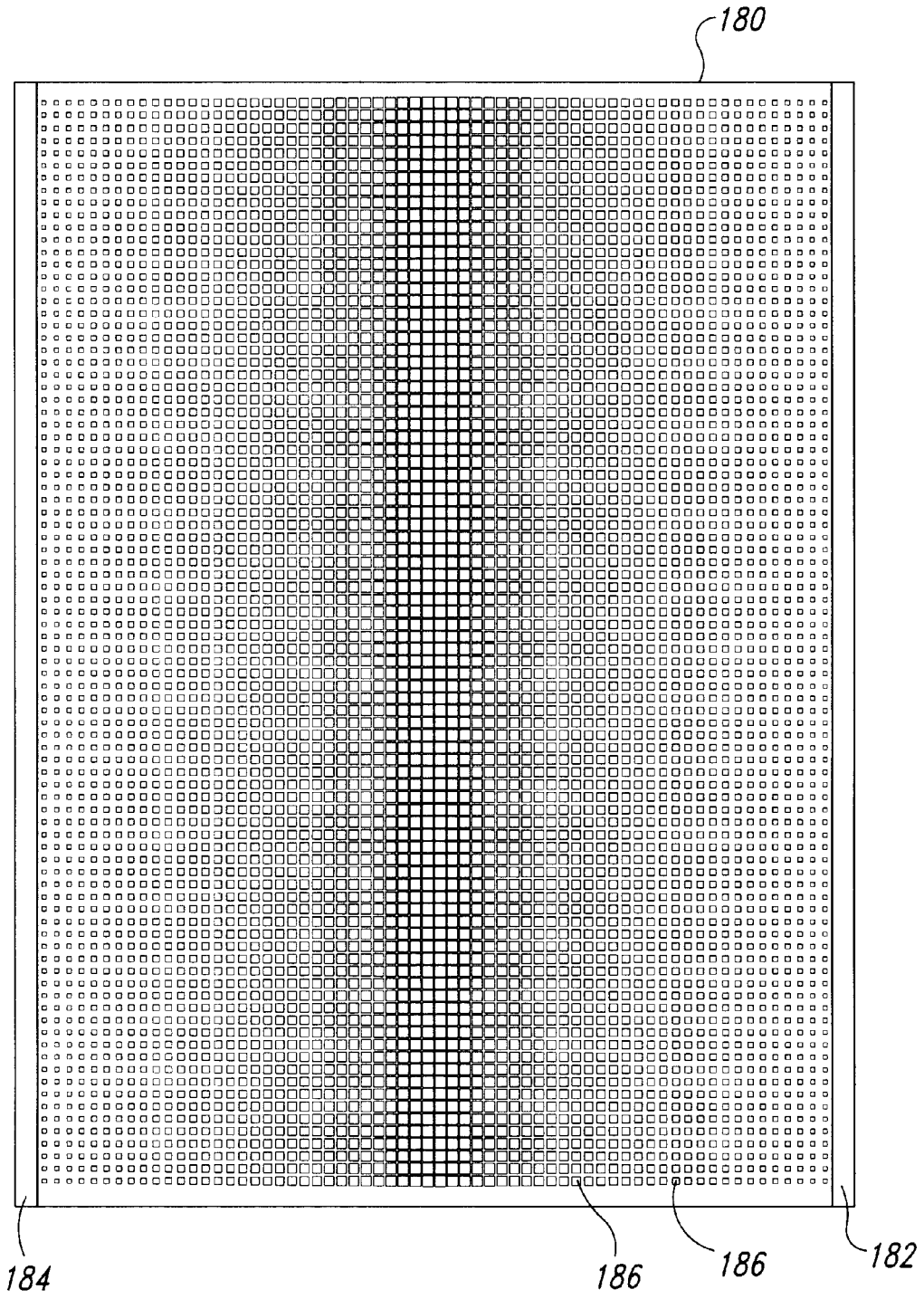
FIG. 4 is a top plan view of the light guide of the lamp of FIGS. 1 and 2.

The light guide 180 may be made from clear acrylic plastic. FIG. 4 illustrates the pattern of indentations 186 in the light guide 180. In an exemplary embodiment, the indentations 186 are formed by laser oblation of the surface of the light guide 180 facing the lamp cover 116. In an alternative embodiment, the indentations 186 may be stamped in the lower surface of the light guide 180 through a conventional machine process.

Thus, the lamp 100 advantageously provides uniform lighting in a high intensity mode for use in high ambient light situations, and a low intensity mode for use in low ambient light applications. The high intensity and low intensity modes of operation are designed to have overlapping light ranges such that the minimum visible light energy in the high intensity mode is less than the maximum visible light energy in the low intensity mode. This overlap provides a continuous adjustment of the visible light energy over a wide range of illuminations.

Figure 5:
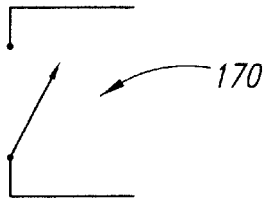
FIG. 5 is a schematic of a manual activation element to switch the lamp of FIGS. 1 and 2 between the first and second modes of operation.
Figure 6:
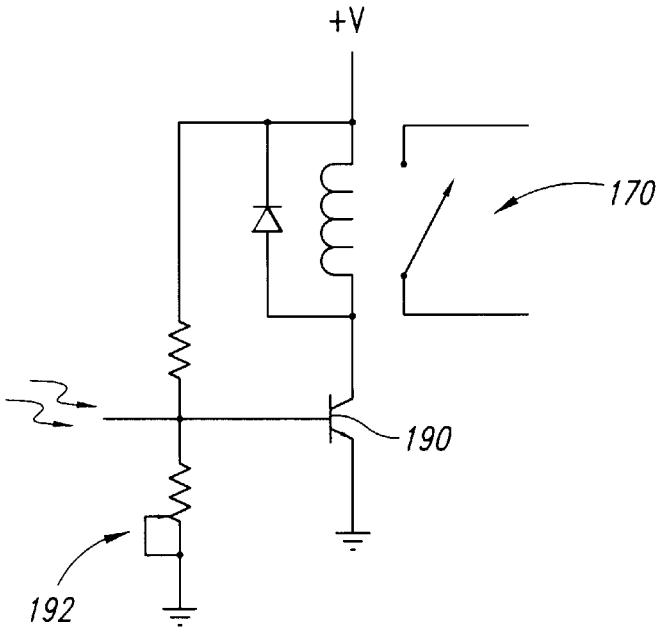
FIG. 6 is a schematic of a circuit to automatically switch the lamp of FIGS. 1 and 2 between the first and second modes of operation.
Figure 7:
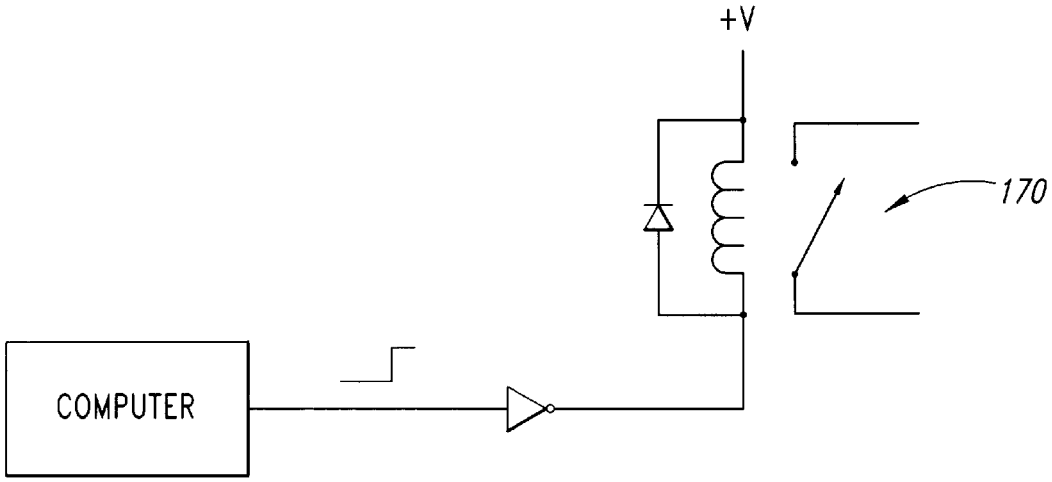
FIG. 7 is a schematic of a remote control system to selectively switch the lamp of FIGS. 1 and 2 between the first and second modes of operation.

Although the basic principles of the lamp 100 have been described, it is clear that many alternative embodiments are also possible. For example, the activation element 170 is illustrated in FIGS. 1 and 2 as a relay. However, the activation element 170 can be a simple mechanical switch, as illustrated in FIG. 5, to allow manual selection of operational modes by a user. In another alternative embodiment, a phototransistor 190 may be used to detect ambient light and switch the activation element 170 thus providing an automatic mode selection based on the ambient light, as illustrated in FIG. 6. An adjustment control 192 may be used to adjust the threshold at which the activation element 170 switches between low intensity and high intensity modes. In yet another exemplary embodiment, illustrated in FIG. 7, an external control device, such as a computer 194, can be used to control the activation element 170. As can be appreciated, there are a number of different ways to switch between the low intensity and high intensity modes.

Figure 8:
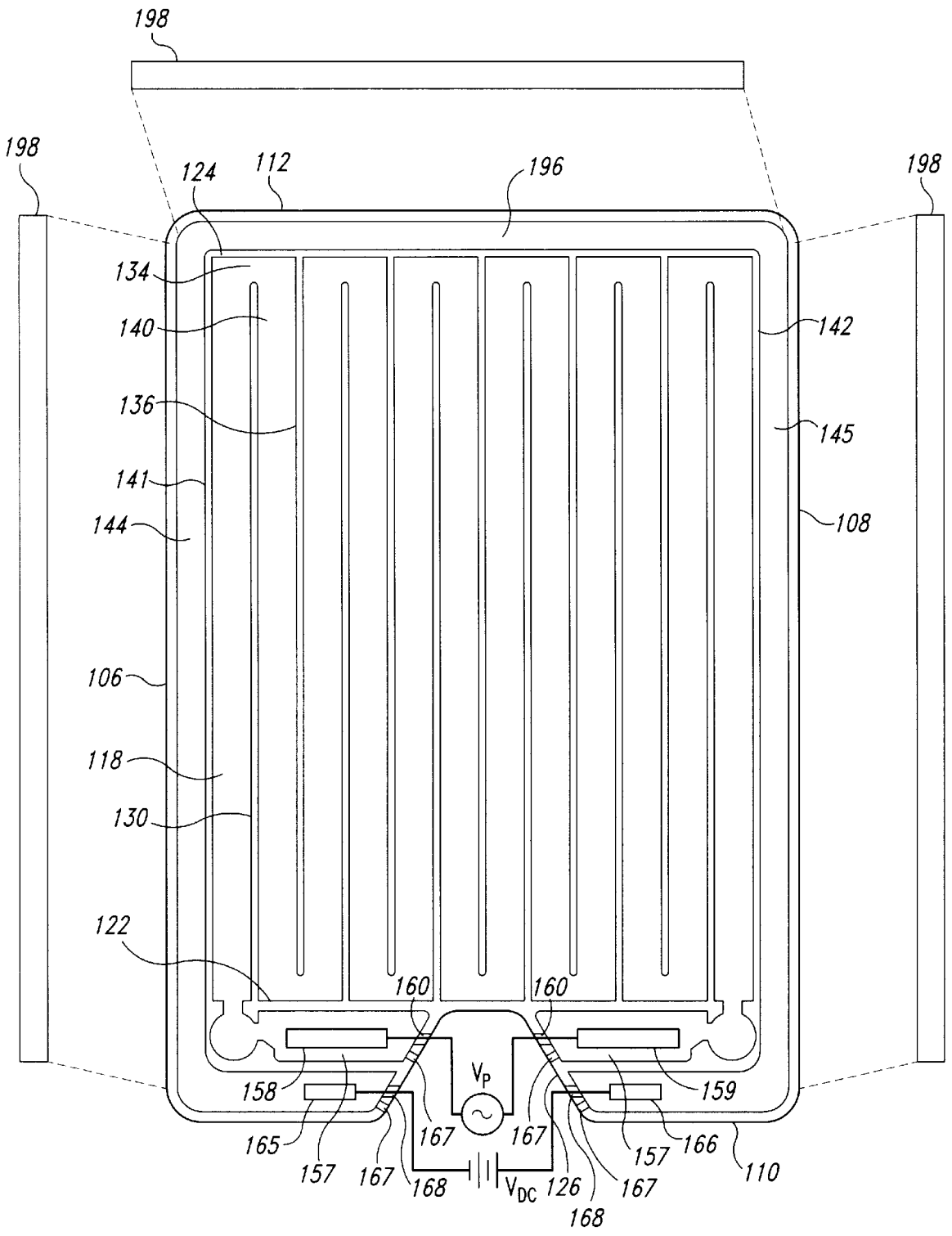
FIG. 8 is a top plan view of an alternative embodiment of the lamp of FIGS. 1 and 2.

The lamp 100 illustrated in FIGS. 1 to 3 is approximately 6 inches by 4.7 inches (6.4 inch diagonal lamp). However, the principles of the present invention may be applied to other lamp sizes to produce different ranges of visible light intensity. In addition, alternative embodiments of the lamp 100 are also possible. The embodiment illustrated in FIGS. 1 to 3A have a single chamber 118 with a common vacuum. However, the lamp 100 may be implemented with two or more separate chambers, as illustrated in FIG. 8. In FIG. 8, the first and second outer channel walls 141 and 142 extend from the second channel endwall all the way to the first endwall 110 so that the serpentine channel 140 is separated from the first and second outer channels 144 and 145 and is under separate vacuum. In this embodiment, the high intensity mode is essentially identical to that described above. That is, the power supply $V_p$ supplies an AC voltage to the first and second primary electrodes 158 and 159 to cause the plasma discharge along the serpentine channel 140. The fluorescent layer 164 (see FIG. 3A) that coats the interior portion of the serpentine channel 140 comprises a variety of phosphors to produce white light, which has a broad electromagnetic spectrum.

In the low intensity mode, the first and second secondary electrodes 165 and 166 are powered by a DC power supply. No power is supplied to the first and second primary electrodes 158 and 159. Upon excitation by the DC power supply, the first and second secondary electrodes 165 and 166 generate the plasma discharge along the first and second outer channels 144 and 145. The first and second outer channels 144 and 145 may be connected near the second end wall 112 to form a single continuous channel 196 along the first and second sidewalls 106 and 108 and the second endwall 112. The fluorescent layer 164 in the first and second outer channels 144 and 145 may comprise only green phosphor, which is required in military and industry standards for night vision instrumentation system (NVIS) compatibility.

The AC signal generated by the power supply $V_p$ in the high intensity mode provides some capacitive coupling across channel walls to provide greater uniformity of illumination in the serpentine channel 140. The DC power supply used to power the first and second secondary electrodes 165 and 166 in the low intensity mode provides no such coupling. This reduces the possibility of inadvertent ionization of gas in the serpentine channel 140 when operating in the low intensity mode. To further improve the NVIS compatibility, the lamp 100 may include one or more pieces of green NVIS filter material 198 over the continuous channel 196 or only over the first and second outer channels 144 and 145 if no fluorescent layer 164 is used in the portion of the continuous channel interconnecting the first and second outer channels. The green NVIS filter material 198 is a commercial product, which covers the entire surface of some military fluorescent displays. As can be appreciated, this NVIS filter material is extremely expensive, costing hundreds of dollars for a 4 inch by 6 inch green filter. The present invention reduces this cost significantly by utilizing green NVIS filter material 196 only along the areas that emit visible light in the low intensity mode. In this manner, the lamp 100 can meet the NVIS compatibility standards for nighttime operation.

Figure 9:
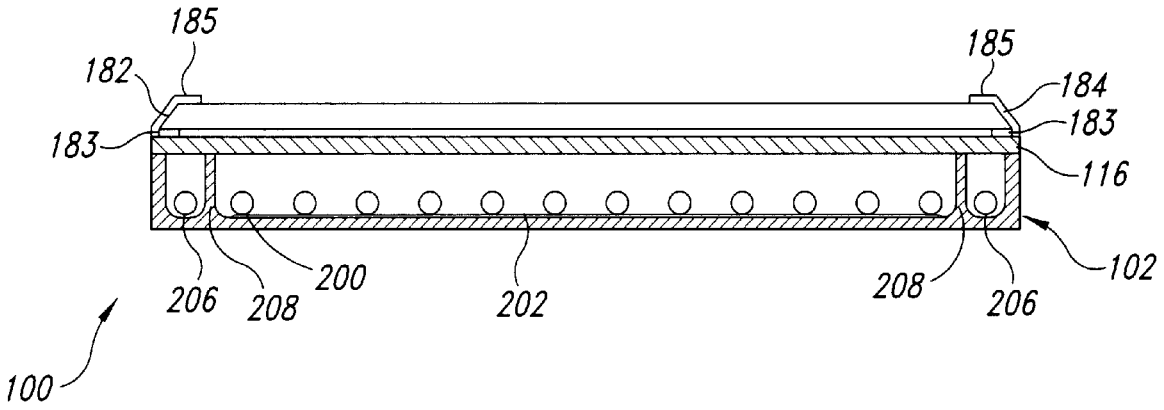
FIG. 9 is a cross-sectional view of an alternative embodiment of the lamp of the present invention.

The embodiment illustrated in FIG. 8 utilizes a single serpentine channel 140 to generate visible light in the high intensity mode. However, those of ordinary skill in the art can appreciate that individual fluorescent tubes may be manufactured with diameters as small as 2 millimeters. In an alternative embodiment, the serpentine channel 140 is replaced by a series of individual fluorescent tubes 200, as illustrated in FIG. 9. Power is applied to one or more of the tubes 200 in the high intensity mode to generate a high level of visible light. For maximum brightness, all of the tubes 200 may be activated. However, to provide a lower intensity light, a portion of the tubes 200 may be activated, such as by way of example, alternating ones of the tubes 200. A reflective surface 202 inside the body 102 of the lamp 100 serves to reflect light towards the cover 116. For operation in the low intensity mode, the lamp 100 may include the first and second outer channels 144 and 145 (see FIG. 8) or may include first and second secondary tubes 206 within the lamp body 102.

Optional interior walls 208 may be used between the tubes 200 and the secondary tubes 206. The optional walls 208 prevent light from the secondary tubes 206 from diffusing through the lamp cover 116 except at regions of the lamp cover near the first and second beveled edges 182 and 184. For NVIS compatibility, the secondary tubes 206 may be designed to emit green light. The NVIS filter material 198 (see FIG. 8) may be installed in proximity with the lamp cover 116 above the secondary tubes 206.

Figure 10A:
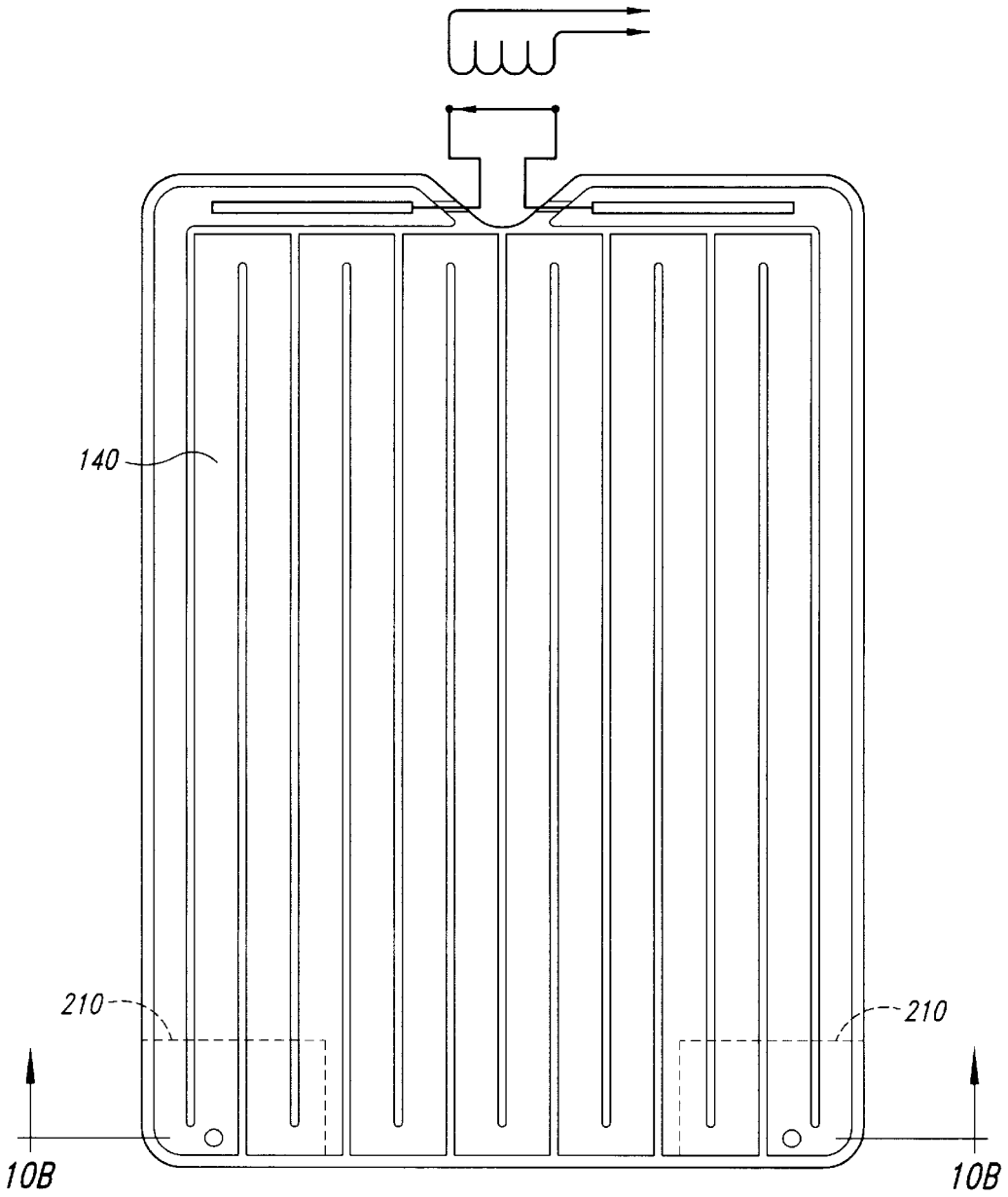
FIG. 10A is a top plan view of an alternative embodiment of the lamp of the present invention.
Figure 10B:
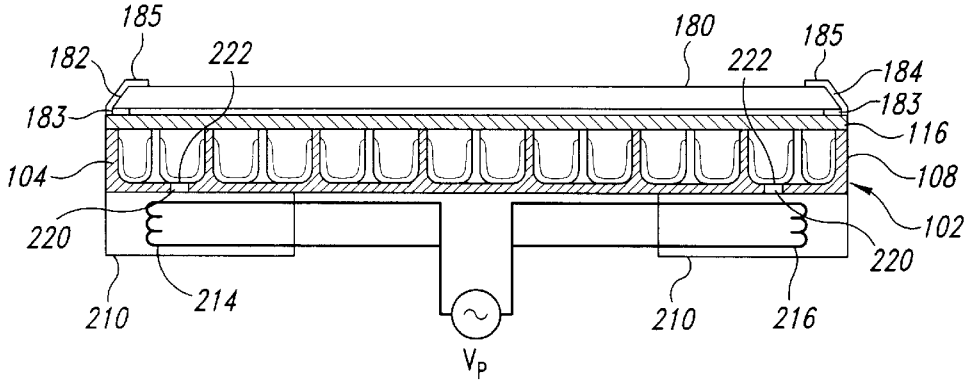
FIG. 10B is a cross-sectional view of the alternative embodiment of FIG. 10A.

FIGS. 1–3A and FIG. 8 illustrate an implementation of the lamp 100 using internal cold cathode electrodes. In an alternative implementation of the lamp 100, hot cathode electrodes may be used to replace the cold cathode electrodes. The hot cathode electrodes may be positioned within the compartments 157 (see FIGS. 1 and 2) or externally installed in external electrode modules 210, as illustrated in FIGS. 10A and 10B. First and second hot cathode type electrodes 214 and 216 are contained within the external electrode modules 210. The first and second electrodes 214 and 216 are coupled to the power supply $V_p$ and receive electrical power therefrom. The electrode modules 210 are bonded, using conventional glass soldering techniques, to the base 104 of the lamp 100. When the electrode modules 210 are bonded to the lamp base 104, apertures 220 in the electrode modules 210 are in alignment and communicate with corresponding apertures 222 in the lamp base. The aligned apertures 220 and 222 permit the flow of the plasma discharge between the first and second electrodes 214 and 216 along the serpentine channel 140 when the lamp 100 is operating in the high intensity mode, or along the first and second outer channels 144 and 145 when the lamp is operating in the low intensity mode.

In addition, a combination of hot cathode electrodes and cold cathode electrodes may be used in the lamp 100. The operation of various internal and external cathodes is well known in the art and will not be described in detail herein.

Figure 11:
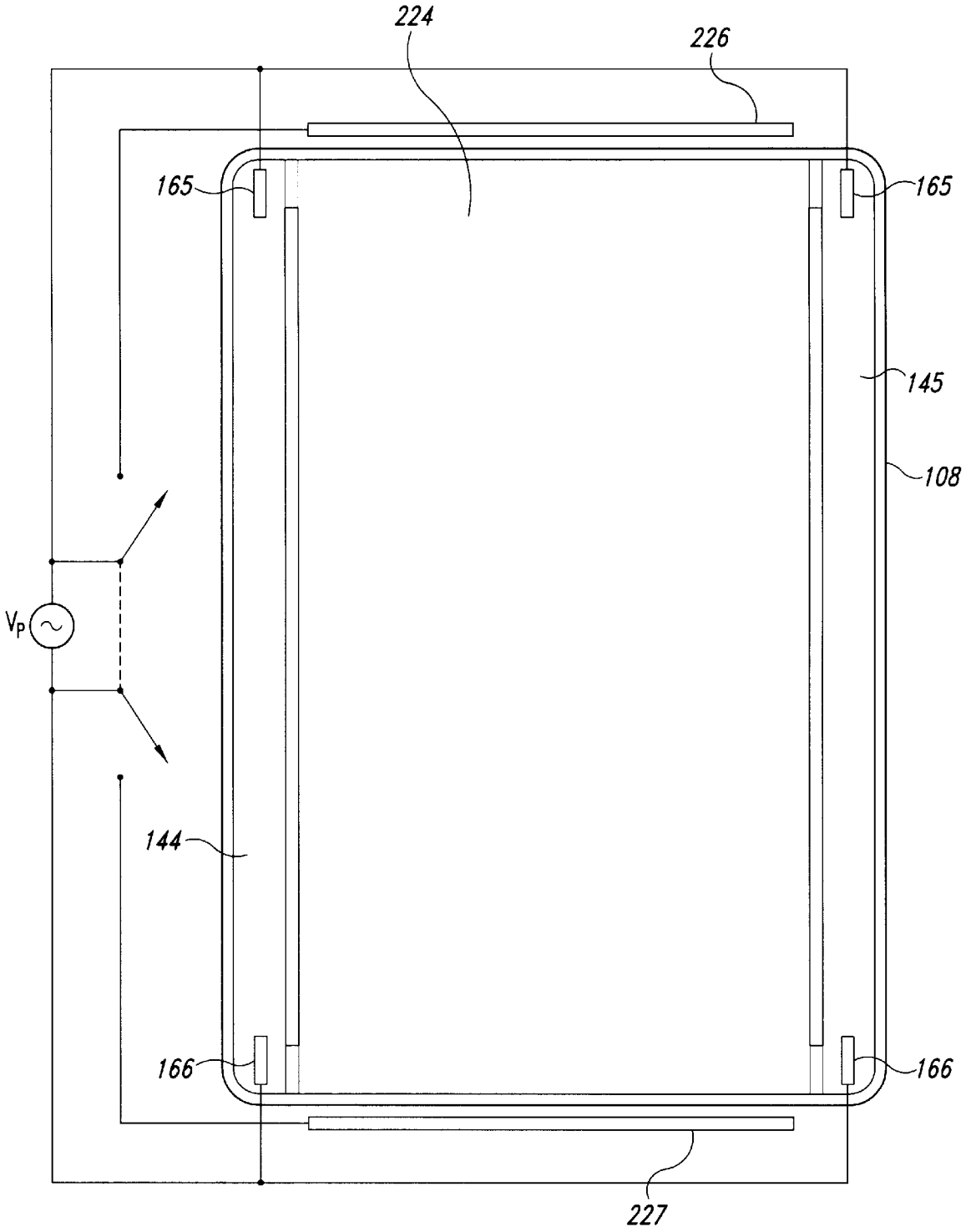
FIG. 11 is a top plan view of another alternative embodiment of the present invention.

The serpentine channel 140 (see FIGS. 1–3A) may be replaced by a single open chamber 224, shown in FIG. 11. As is known in the art, electrodes 226 and 227 are mounted outside the chamber 224 and generate an electric field in the high intensity mode of operation. The electric field excites the gas within the chamber 224 to produce the photoluminescent effect. This embodiment is sometimes called an electrodless lamp because the electrodes 226 and 227 are not in contact with the gas within the chamber 224. The electrodes 165 and 166 are mounted within each of the first and second outer channels 144 and 145 to generate light in the first and second outer channels in the manner previously described. In FIG. 11, the electrodes 165 and 166 are continuously powered and thus generate light in both the low intensity mode and the high intensity mode. However, additional circuitry (not shown) can control power such that light is produced in first and second outer channels 144 and 145 only in the low intensity mode.

Figure 12:
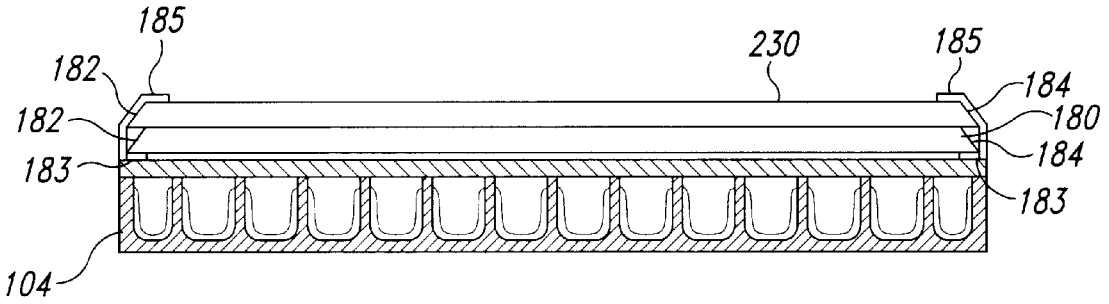
FIG. 12 is a cross-sectional view of an alternative embodiment of a lamp constructed according to the principles of the present invention.

The lamp 100 may also include different embodiments of the light guide 180. In FIG. 12, a second light guide 230 is placed directly on top of the light guide 180. The light guide 230 also contains indentations 186, previously described with respect to the light guide 180. The reflective member 185 is sized to fit over both the light guide 180 and the light guide 230. In a preferred embodiment, each of the light guides 180 and 230 have indentations 186 (see FIG. 3B) to deflect light from the beveled edges 182 and 184.

Figure 13:
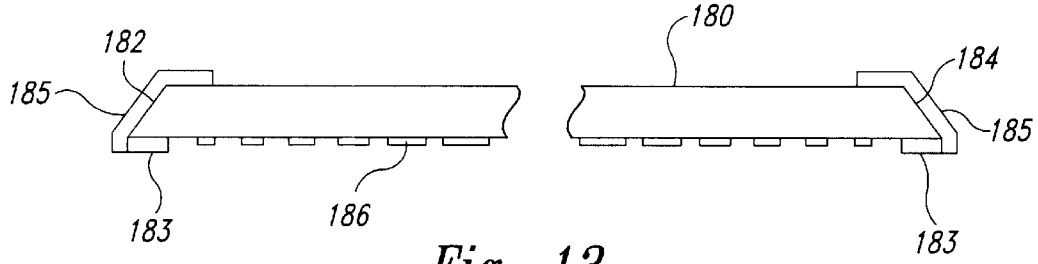
FIG. 13 is a cross-sectional view of an alternative embodiment of the light guide of the present invention.

In yet another embodiment, shown in FIG. 13, the indentations 186 (see FIG. 3B) are replaced by a half-tone pattern 236 on the surface of the light guide 180 facing toward the lamp cover 116 (see FIG. 3A). The half-tone pattern 236 has a maximum pattern density near the central portion of the length of the light guide 180 and decreases in density as it approaches the beveled edges 182 and 184.

Figure 14:
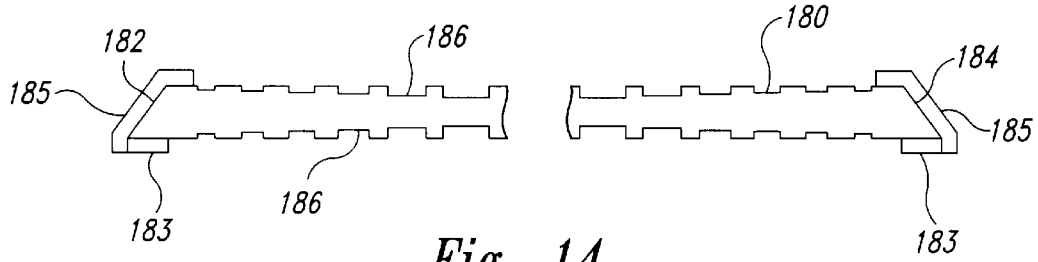
FIG. 14 is a cross-sectional view of another alternative embodiment of the light guide of the present invention.

In yet another alternative embodiment, illustrated in FIG. 14, indentations 186 are made in both the top and bottom surfaces of the light guide 180. As previously described, the indentations 186 have a maximum depth and density in the central portion of the length of the light guide 180 and decrease in depth and density in the area near the beveled edges 182 and 184. Similarly, the indentations 186 on the top surface of the light guide 180 have maximum depth and density near the central portion of the light guide and decrease in depth and density near the beveled edges 182 and 184.

Figure 15:
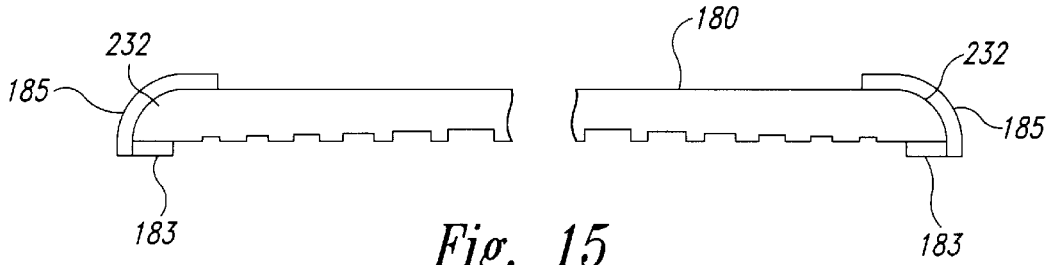
FIG. 15 is a cross-sectional view of yet another alternative embodiment of the lamp of the present invention.

In yet another alternative embodiment, illustrated in FIG. 15, the light guide 180 includes radiused ends 232 to reflect light from the first and second outer channels 144 and 145.

Figure 16:
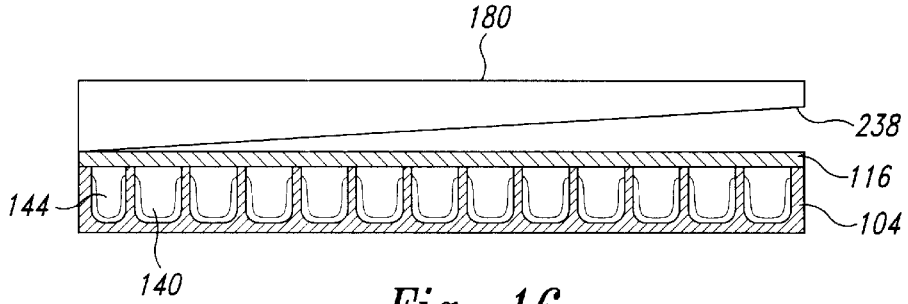
FIG. 16 is a cross-sectional view of yet another alternative embodiment of the lamp of the present invention.

In yet another alternative embodiment, FIG. 16 depicts the light guide 180 as a wedge-shaped translucent material to diffuse the light from the serpentine channel 140 and a single outer channel 144. The wedge-shaped light guide 180 may also include an optional half-mirrored surface 238 on the side of the light guide facing the lamp cover 116. Light from the serpentine channel 140 passes through the half-mirrored surface 238 and is diffused by the light guide 180. Light entering from the first outer channel 144 enters the light guide 180 at the edge of the bottom surface and is diffused along the length of the light guide 180. The half-mirrored surface 238 causes light which is diffused towards the lamp cover 116 to be reflected away from the lamp cover, thus providing a uniform diffuse low level of light.

Figure 17:
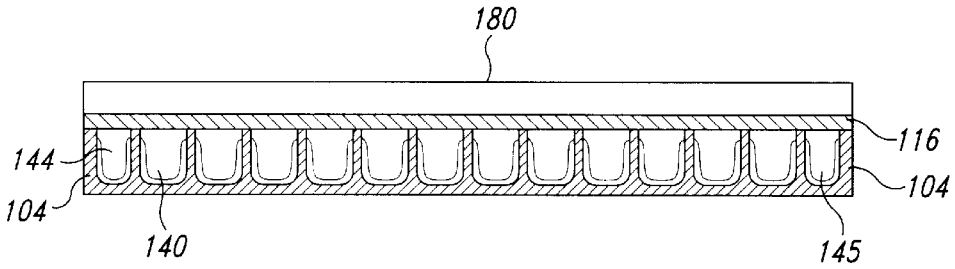
FIG. 17 is a cross-sectional view of yet another alternative embodiment of the lamp of the present invention.

In another embodiment, FIG. 17 depicts the light guide 180 as a rectangular-shaped translucent block that diffuses light from the serpentine channel 140 and the first and second outer channels 144 and 145. Although the rectangular block-shaped light guide 180 is less efficient at transmitting the light from the first and second outer channels 144 and 145, operation of the lamp in the low intensity mode does not require significant levels of light. Therefore, the translucent rectangular-shaped light guide 180 can perform satisfactorily in both the low intensity mode and high intensity mode.

Figure 18:
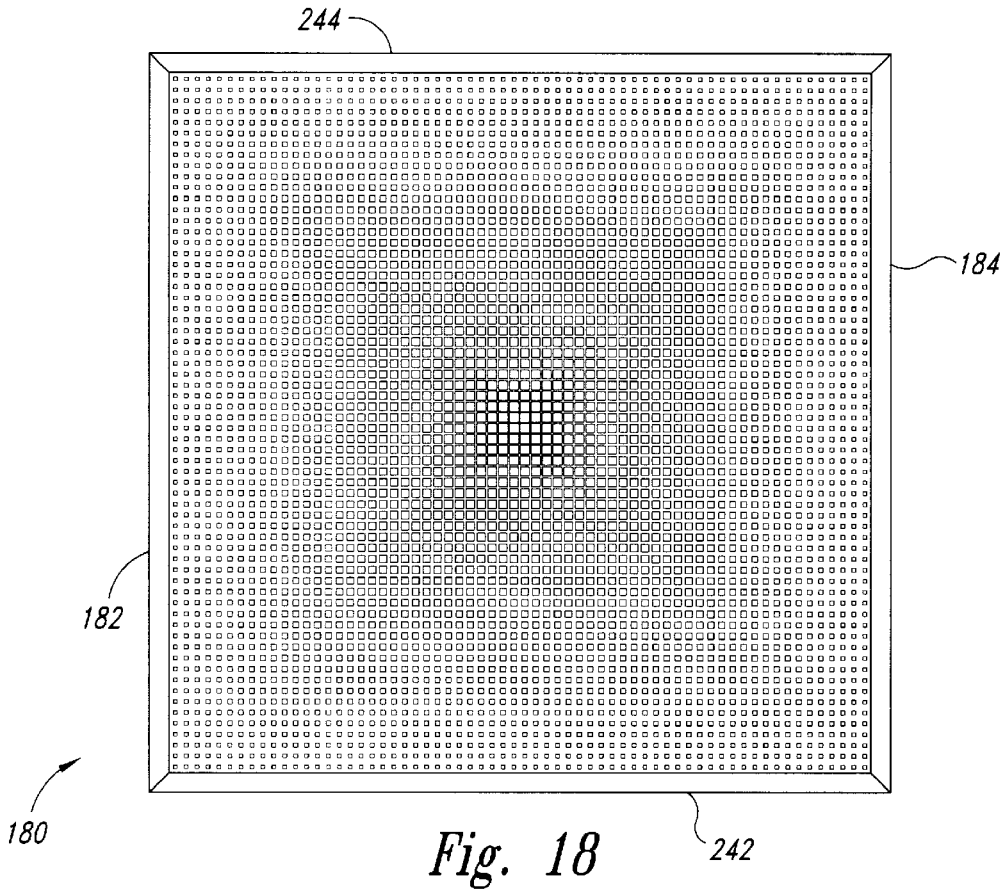
FIG. 18 is a top plan view of yet another alternative embodiment of the light guide of the lamp of the present invention.

In yet another alternative embodiment, FIG. 18 illustrates the light guide 180 with four beveled edges to deflect light in the low intensity mode. In this embodiment, the lamp 100 may include secondary tubes 206 (see FIG. 9) along the peripheral edges of the lamp in proximity with the first and second sidewalls 106 and 108 (see FIGS. 1 and 2). The beveled edges 182 and 184 serve to deflect light emitted by the secondary tubes 206 along the first and second sidewalls 106 and 108 in the manner previously described. In addition, light from secondary tubes (not shown) located in proximity with the first and second endwalls 110 and 112 are deflected by beveled edges 242 and 244, respectively. The light guide 180 illustrated in FIG. 18 may also include a series of indentations (see FIG. 3A) that have a maximum depth and density near the central portion of the light guide and decrease in depth and density near the four beveled edges 182, 184, 242 and 244. The lamp 100 may include channels around the entire peripheral edge of the lamp body 102. The light guide 180 illustrated in FIG. 16 may be used to deflect light from the four peripheral edges of the lamp body 102 in the manner described above.

Figure 19:
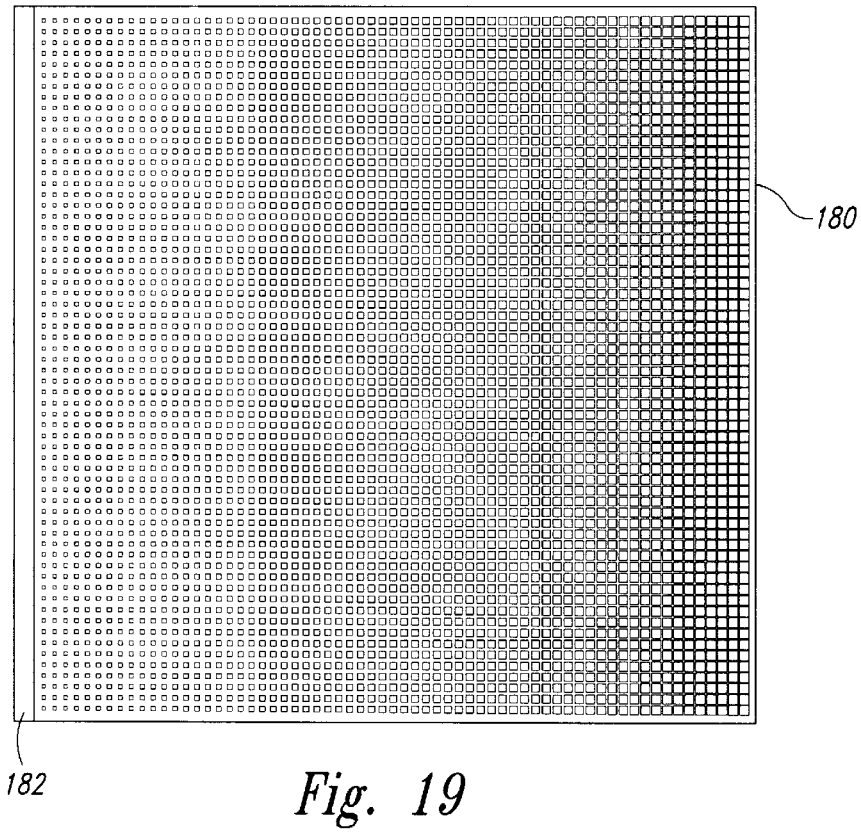
FIG. 19 is a top plan view of yet another alternative embodiment of the light guide of the lamp of the present invention.

In another alternative embodiment, the light guide 180 may include only a single beveled edge 182, as illustrated in FIG. 19. In this embodiment, the lamp operates in the low intensity mode to produce light along a single channel, such as the first outer channel 144 (see FIG. 2) or using one or more secondary tubes 206 along a single edge of the lamp 100. The beveled edge 182 operates in a manner previously described to deflect the light along the length of the light guide 180. In a preferred embodiment, the light guide 180 illustrated in FIG. 19 includes indentations 186 (see FIG. 3B) that increase in depth and density at the distal edge of the light guide 180 opposite the beveled edge 182. The depth and density of the indentations 186 incrementally decrease in the direction toward the beveled edge 182.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A planar photoluminescent lamp, comprising:

a lamp body having a plurality of sidewalls and endwalls and a base;

a lamp cover mounted to the lamp body such that the lamp body and the cover define a chamber having a channel length extending from a first end to a second end;

a first set of electrodes spaced apart within the chamber in proximity with the first and second ends, respectively, to produce an electrical discharge between a first of the first set of electrodes and a second of the first set of electrodes along the channel length when supplied with electrical power;

a second set of electrodes spaced apart within the chamber at positions other than the first and second ends to produce an electrical discharge between the first and second electrodes of the first set of electrodes along a discharge path shorter than the channel length;

an activation element to selectively activate the second set of electrodes;

a gas within the chamber to emit ultraviolet energy in response to the electrical discharge, the gas emitting a first quantity of ultraviolet energy in response to the electrical discharge along the channel length and emitting a second quantity of ultraviolet energy less than the first quantity of ultraviolet energy in response to the electrical discharge along the shortened discharge path; and a photoluminescent material within the chamber to produce visible light in response to the ultraviolet energy, whereby a first quantity of visible light is produced in response to the first quantity of ultraviolet energy and a second quantity of visible light less than the first quantity of visible light is produced in response to the second quantity of ultraviolet energy.

2. The lamp of claim 1 wherein the first set of electrodes are configured to receive an electrical voltage when supplied with electrical power, and the second set of electrodes are positioned within the chamber to provide an electrical short circuit of a portion of the discharge path from the first end to the second end to thereby shorten the discharge path.

3. The lamp of claim 1, further including a barrier wall extending from the base to the cover to isolate the first set of electrodes from the chamber, the barrier including a first aperture at the first end of the chamber and a second aperture at the second end of the chamber to permit passage of the electrical discharge between the first and second electrodes along the channel length.

4. The lamp of claim 1, further including a barrier wall extending from the base to the cover to isolate the second set of electrodes from the chamber, the barrier including first and second apertures in proximity with the second set of electrodes to permit passage of the electrical discharge between the first and second electrodes along the shortened discharge path.

5. The lamp of claim 1, further including first and second outer walls extending from the base to the cover to define first and second outer channels with the first set of electrodes positioned at a first end of the first and second outer channels and the second set of electrodes positioned at a second end of the first and second outer channels to permit passage of the electrical discharge between the first and second electrodes along the shortened discharge path.

6. The lamp of claim 1, further including a light diffusion element mounted adjacent the lamp cover to diffuse the visible light.

7. The lamp of claim 6 wherein the light diffusion element diffuses the second quantity of visible light emitted along the shortened discharge path.

8. The lamp of claim 6 wherein the light diffusion element contains a plurality of indentations on a surface thereof to provide uniform diffusion of light.

9. The lamp of claim 1, further including first and second outer walls extending from the base to the cover to define first and second outer channels wherein passage of the electrical discharge between the first and second electrodes along the shortened discharge path occurs in the first and second outer channels.

10. The lamp of claim 9, further including a light diffusion element to guide and diffuse the second quantity of visible light from the first and second outer channels.

11. A gas-filled planar photoluminescent lamp containing a photoluminescent material to emit visible light in response to an plasma discharge, comprising:

a lamp body;

a lamp cover mounted to the lamp body such that the lamp body and the cover define a chamber having a channel length extending from a first end to a second end;

a first electrode in proximity with the first end;

a second electrode in proximity with the second end, said first and second electrodes configured to produce the plasma discharge therebetween along the channel length when supplied with electrical power;

a set of secondary electrodes spaced apart within the lamp body at positions other than the first and second ends to produce the plasma discharge along an altered discharge path different from the channel length discharge path; and an activation element to selectively activate the second set of electrodes, whereby the lamp produces a first quantity of visible light in response to the plasma discharge along the channel length discharge path and a second quantity of visible light less than the first quantity of visible light in response to the plasma discharge along the altered discharge path.

12. The lamp of claim 11 wherein the first and second electrodes are configured to receive an electrical voltage when supplied with electrical power, and the set of secondary electrodes are positioned within the chamber to provide an electrical short circuit of a portion of the channel discharge path from the first end to the second end to thereby alter the discharge path.

13. The lamp of claim 11, further including a passageway between the channel length discharge path and the altered discharge path sized to permit common pressurization of the channel length discharge path and the altered discharge path.

14. The lamp of claim 11 wherein the channel length discharge path and the altered discharge path are atmospherically isolated from each other.

15. The lamp of claim 14 wherein the altered discharge path contains a different photoluminescent material than the channel length discharge path, and the photoluminescent lamp produces the visible light at a first selected wavelength in response to the plasma discharge along the channel length discharge path and produces the visible light at a second selected wavelength different from first selected wavelength in response to the plasma discharge along the altered discharge path.

16. The lamp of claim 11, further including a light diffusion element mounted adjacent the lamp cover to diffuse the visible light.

17. The lamp of claim 16 wherein the light diffusion element diffuses the second quantity of visible light emitted along the altered discharge path.

18. The lamp of claim 17, further including first and second beveled edges on the light diffusion element parallel to the altered discharge path to deflect visible light produced along the altered discharge path.

19. The lamp of claim 18, further including a reflection member located in proximity with the first and second beveled edges to reflect visible light produced along the altered discharge path.

20. The lamp of claim 16 wherein the light diffusion element contains a plurality of indentations on a surface thereof to provide uniform diffusion of light.

21. The lamp of claim 11, further including first and second outer walls extending from a base of the lamp to the lamp cover to define first and second outer channels wherein passage of the plasma discharge between the first and second electrodes along the altered discharge path occurs in the first and second outer channels.

22. The lamp of claim 21, further including a light diffusion element to guide and diffuse the second quantity of visible light from the first and second outer channels.

23. The lamp of claim 22, further including first and second beveled edges on the light diffusion element parallel to the first and second outer channels to deflect visible light produced along the first and second outer channels.

24. The lamp of claim 23, further including a reflection member located in proximity with the first and second beveled edges to reflect visible light produced along the first and second outer channels.

25. The lamp of claim 11 wherein the first and second cathodes are a cold cathode type.

26. A gas-filled planar photoluminescent lamp, comprising:

a lamp housing having a channel with first and second ends;

a first electrode associated with the housing in proximity with the channel first end;

a second electrode associated with the housing in proximity with the channel second end, said first and second electrodes configured to produce an plasma discharge therebetween in a first discharge path along the channel when supplied with electrical power;

a photoluminescent material deposited along the discharge path to emit visible light in response to the plasma discharge; and an electrical circuit selectively activated to provide a second discharge path different from the first discharge path.

27. The lamp of claim 26, further including a set of secondary electrodes spaced apart at positions other than the first and second ends and coupled to the electrical circuit to produce the plasma discharge along the second discharge path.

28. The lamp of claim 27 wherein the set of secondary electrodes are passive electrodes that are electrically coupled together by the electrical circuit.

29. The lamp of claim 27 wherein the electrical circuit includes an electrical power supply to activate the set of secondary electrodes.

30. The lamp of claim 26, further including a light sensing circuit to measure ambient light, the electrical circuit being coupled to and activated by the light sensing circuit.

31. The lamp of claim 26, further including a photoluminescent material deposited along the second discharge path to emit visible light in response to the plasma discharge along the second discharge path.

32. The lamp of claim 31 wherein the photoluminescent material deposited along the first discharge path is different from the photoluminescent material deposited along the second discharge path.

33. The lamp of claim 26, further including a passageway between the first discharge path and the second discharge path sized to permit common pressurization of the first and second discharge paths.

34. The lamp of claim 26 wherein the first discharge path and the second discharge path are atmospherically isolated from each other.

35. The lamp of claim 34 wherein the second discharge path contains a different photoluminescent material than the first discharge path, and the photoluminescent lamp produces the visible light at a first selected wavelength in response to the plasma discharge along the first discharge path and produces the visible light at a second selected wavelength different from first selected wavelength in response to the plasma discharge along the second discharge path.

36. The lamp of claim 26, further including a light diffusion element mounted adjacent the lamp housing to diffuse the visible light.

37. The lamp of claim 36 wherein the light diffusion element diffuses the second quantity of visible light emitted along the second discharge path.

38. The lamp of claim 36 wherein the light diffusion element contains a plurality of indentations on a surface thereof to provide uniform diffusion of light.

39. A planar photoluminescent lamp, comprising:

a lamp housing;

a first light source within the lamp housing to generate visible light in a first operational mode;

a second light source within the lamp housing in a substantially planar arrangement with respect to the first light source, said second light source generating visible light in a second operational mode;

a circuit to alternatively select the first or second operational modes for the lamp; and a light diffusion element mounted adjacent the lamp housing to diffuse the visible light in the first and second operational modes, the light diffusion element having a first surface facing toward the first and second light sources to receive light generated in both the first and second operational modes, and a second surface opposite said first surface to emit light in both the first and second operational modes.

40. The lamp of claim 39 wherein the first light source comprises a serpentine channel formed by the lamp housing and coated with a photoluminescent material, the serpentine channel being filled with a gas to react with the photoluminescent material in the presence of an plasma discharge to generate the visible light in the first operational mode.

41. The lamp of claim 40 wherein the second light source comprises at least a first channel formed along a peripheral edge of the lamp housing and coated with a photoluminescent material, the first channel being filled with a gas to react with the photoluminescent material in the presence of an plasma discharge to generate the visible light in the second operational mode.

42. The lamp of claim 40 wherein the serpentine channel and the first channel are coated with similar photoluminescent material and are atmospherically coupled together with visible light in the first and second operational modes having similar spectral characteristics.

43. The lamp of claim 40 wherein the serpentine channel and the first channel are each coated with a different photoluminescent material and are atmospherically isolated from each other with visible light in the first operational mode having different spectral characteristics than the visible light in the second operational mode.

44. The lamp of claim 39 wherein the second light source comprises at least a first photoluminescent tube within the lamp housing.

45. The lamp of claim 39 wherein the first light source comprises a plurality of individual photoluminescent tubes mounted within the lamp housing.

46. The lamp of claim 45 wherein the second light source comprises at least a first channel formed along a peripheral edge of the lamp housing and coated with a photoluminescent material, the first channel being filled with a gas to react with the photoluminescent material in the presence of a discharge arc to generate the visible light in the second operational mode.

47. The lamp of claim 46 wherein the plurality of individual photoluminescent tubes and the first channel are coated with similar photoluminescent material generate visible light in the first and second operational modes having similar spectral characteristics.

48. The lamp of claim 46 wherein the serpentine channel and the first channel are each coated with a different photoluminescent material and are atmospherically isolated from each other with visible light in the first operational mode having different spectral characteristics than the visible light in the second operational mode.

49. The lamp of claim 39 wherein the second light source comprises at least a first photoluminescent tube within the lamp housing.

50. The lamp of claim 39 wherein the first light source comprises an open chamber photoluminescent light source.

51. The lamp of claim 39, further including first and second electrodes as part of the first light source to generate an plasma discharge therebetween when electrical power is applied thereto.

52. The lamp of claim 51 wherein the first and second electrodes are cold cathode type electrodes.

53. The lamp of claim 52 wherein the first and second electrodes are internal electrodes mounted within the lamp housing.

54. The lamp of claim 52 wherein the first and second electrodes are external electrodes mounted outside the lamp housing.

55. The lamp of claim 51 wherein the first and second electrodes are hot cathode type electrodes.

56. The lamp of claim 55 wherein the first and second electrodes are internal electrodes mounted within the lamp housing.

57. The lamp of claim 55 wherein the first and second electrodes are external electrodes mounted outside the lamp housing.

58. The lamp of claim 39 wherein the light diffusion element includes a first beveled edge proximate the second light source to deflect light generated in the second operational mode.

59. The lamp of claim 58 wherein the light diffusion element includes a series of indentations to further deflect light generated in the second operational mode and thereby direct light out of the second surface of the light diffusion element.

60. The lamp of claim 58, further including a light reflecting element associated with the beveled edge to reflect light from the beveled edge.

61. The lamp of claim 58 wherein the light diffusion element includes a half-tone pattern on a selected one of the first and second surfaces to diffuse light.

62. The lamp of claim 58 wherein the light diffusion element includes a half-mirrored surface on the first surface to reflect light generated by the second light source.

63. The lamp of claim 39 wherein the light diffusion element includes a plurality of beveled edges proximate the second light source to deflect light generated in the second operational mode.

64. The lamp of claim 63, further including a light reflecting element associated with the beveled edge to reflect light from the beveled edge.

65. The lamp of claim 39 wherein the light diffusion element includes a plurality of rounded edges proximate the second light source to deflect light generated in the second operational mode.

66. The lamp of claim 39 wherein the light diffusion element is a wedge shaped element.

67. The lamp of claim 39 wherein the light diffusion element is a rectangular shaped block.

* * * * *